US007131878B2

(12) United States Patent
Austevoll et al.

(10) Patent No.: US 7,131,878 B2
(45) Date of Patent: Nov. 7, 2006

(54) DEVICE OF A BASKET FOR SCOOPING UP OBJECTS

(76) Inventors: Wilhelm Magne Austevoll, Hamre, N-5379 Steinsland (NO); Ellisiv B. Austevoll, Hamre, N-5379 Steinsland (NO)

( * ) Notice: Subject to any disclaimer, the term of this patent is extended or adjusted under 35 U.S.C. 154(b) by 0 days.

(21) Appl. No.: 11/090,710

(22) Filed: Mar. 25, 2005

(65) Prior Publication Data

US 2005/0223965 A1 Oct. 13, 2005

(51) Int. Cl.
*B63C 7/00* (2006.01)

(52) U.S. Cl. ..... 441/80; 114/365

(58) Field of Classification Search ..... 441/80; 114/365

See application file for complete search history.

(56) References Cited

U.S. PATENT DOCUMENTS 4,610,635 A * 9/1986 Austevoll ..... 441/80
4,678,446 A * 7/1987 Dahan ..... 441/80
4,861,299 A * 8/1989 Ueberschaer ..... 441/80

* cited by examiner

*Primary Examiner*—Stephen Avila
(74) *Attorney, Agent, or Firm*—Banner & Witcoff, Ltd.

(57) ABSTRACT

A device for a basket (20) for scooping up or rescuing objects lying in the sea is described, where the basket, in connection to a landing site, such as onboard a vessel (10), can be shifted from a parked position to a scooping up position adjoining the sea surface (11), and vice versa, and a drive gear is arranged to operate the basket via a mounting unit, to provide said position shift. The device is characterised in that the mounting unit is an extended body (30) which is fastened to the basket (20), and the shift between the positions occurs in that the body (30) is displaced axially, and for placing the basket (20) in the correct rescue position in relation to the object, the body (30) is subjected to a rotary movement about its longitudinal axis.

19 Claims, 9 Drawing Sheets

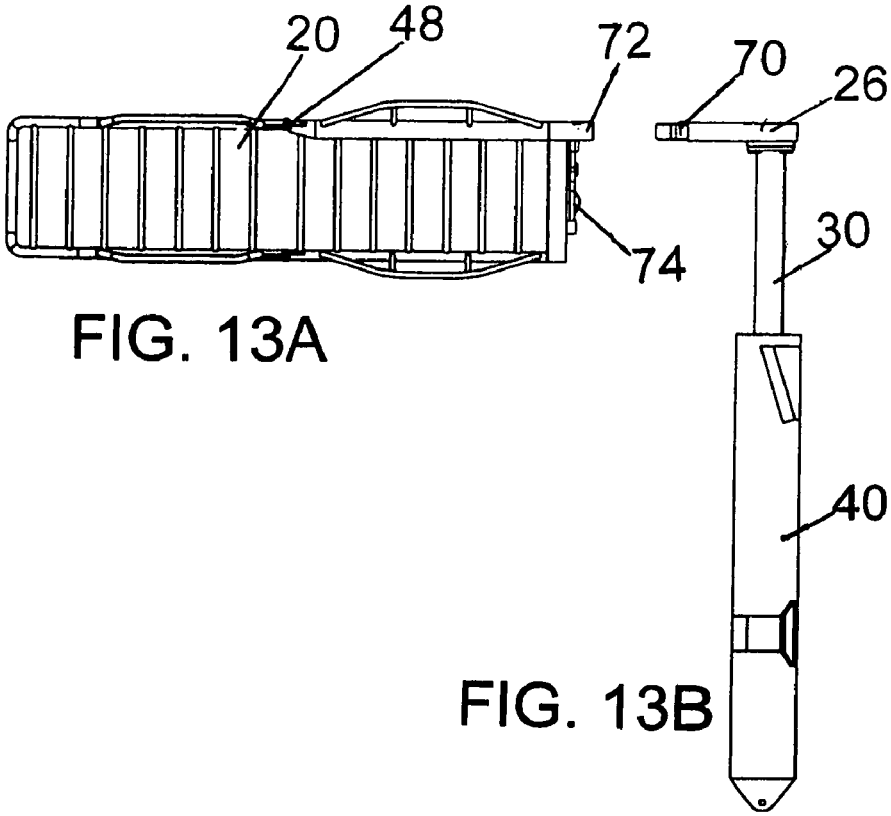
FIG. 13A
FIG. 13B
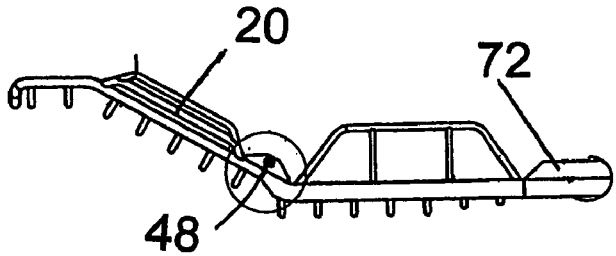
FIG. 14A
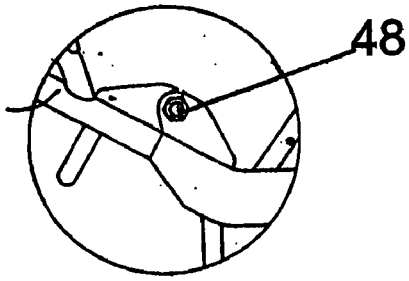
FIG. 14B

DEVICE OF A BASKET FOR SCOOPING UP OBJECTS

This application claims priority to Norwegian Patent Application No. 20041259, filed Mar. 26, 2004, herein incorporated by reference in its entirety.

FIELD OF THE INVENTION

The present invention relates to a device for a basket (or a stretcher) for scooping up or rescuing objects which lie in the sea and methods for application of the device.

BACKGROUND OF THE INVENTION

Previously, different methods to scoop objects or persons up from the sea with the help of baskets and similar scooping means are known. Common to such methods is that the rescue vessel encompasses a mechanism, as mentioned above, which is operated by one or more of the crew members. But normally, the mechanisms can not be operated by the pilot of the ship alone.

Furthermore, the launching mechanisms are very complex and require equipment which needs a lot of space in order to function.

It is an object of the invention to provide a new construction for a rescue system of the abovementioned kind.

One of the objects of the invention is to provide a simple mechanical system which offers a simple launching of the rescue basket (or stretcher).

It is also an object of the invention that the new construction for launching the rescue basket, scooping up and bringing onboard the rescued person can be operated by one single person onboard the vessel. This means that the rescue vessel can be one-man operated, and still the pilot can operate the rescue equipment according to the invention without having to leave his seat from where he controls the operation of the vessel.

BRIEF SUMMARY OF THE INVENTION

The present invention relates to a device for a basket (or a stretcher) for scooping up or rescuing objects which lie in the sea, where the basket, in connection to a landing site, such as onboard a vessel, can be shifted from a parked position to a scooping up position adjoining the sea surface, and vice versa, and a driving gear arranged to operate the basket via a mounting unit to provide the mentioned shift of positions.

The invention also relates to methods for application of the device.

The term objects can comprise any items which float in the sea, but relates in this regard in particular to a person or persons which shall be brought onboard a rescue vessel from the sea.

The scooping up basket is characterised in that the mounting unit is an extended body that is fastened to the basket and the shifting between the positions occurs in that the body is displaced axially and in order to place the basket in a correct rescue position with regard to the object, the body is subjected to a rotational movement about its longitudinal axis.

The preferred embodiments of the invention appear in the dependent claims 2–15.

According to the invention the device is used according to the preceding claims in connection with a vessel such as a rescue vessel.

According to another preferred embodiment of the invention the device is applied in connection to a landing site, such as a quay, where the basket is set up to be shifted between its horizontal position on the quay and its inclined position down in the sea where objects or persons can be rescued ashore.

The invention provides for a new and unusual construction in the way one (the pilot) steers and, at the same time may operate the system for rescuing objects (persons) on board. The basket of the system can also be used as a stretcher, in addition to its railing and gangway modes, etc. The scooping up itself, where a net or a wicket scoops the person up from the sea is previously known, but the means of taking onboard persons and storing the construction, and also other mentioned application areas, have not been known previously. The system according to the invention will, to a large extent, overcome the abovementioned disadvantages of the known solutions.

In the following description of the various embodiments, reference is made to the accompanying drawings, which form a part hereof, and in which is shown by way of illustration various embodiments in which the invention may be practiced. It is to be understood that other embodiments may be utilized and structural and functional modifications may be made without departing from the scope of the present invention.

BRIEF DESCRIPTION OF THE DRAWINGS

The invention shall be explained in more detail with reference to the following figures, in which:

FIG. 10 shows the basket in its upright vertical position.

FIG. 11 shows a the basket in its mainly horizontal position.

FIG. 12 shows the basket in its downwardly tilted position.

FIGS. 13A and 13B shows plan views of the embodiment where the basket may be released from the mechanism as a stretcher.

FIG. 14A also shows a side view of the pivoting hinge 48 of the basket. The pivot hinge detail is shown in FIG. 14B.

DETAILED DESCRIPTION OF THE INVENTION

The new features of the invention relate to all mechanical elements being located and operating inside a closed channel. By means of a free wheel, a guiding wheel and wheel tracks, and the use of one single power source, the special fastening mechanism of the scooping up basket, may displace the basket into different angles/positions.

The operational advantages involves that only one steering function to handle is needed, something which ensures that the system can be operated by the same person who is piloting the vessel.

Figure 1:
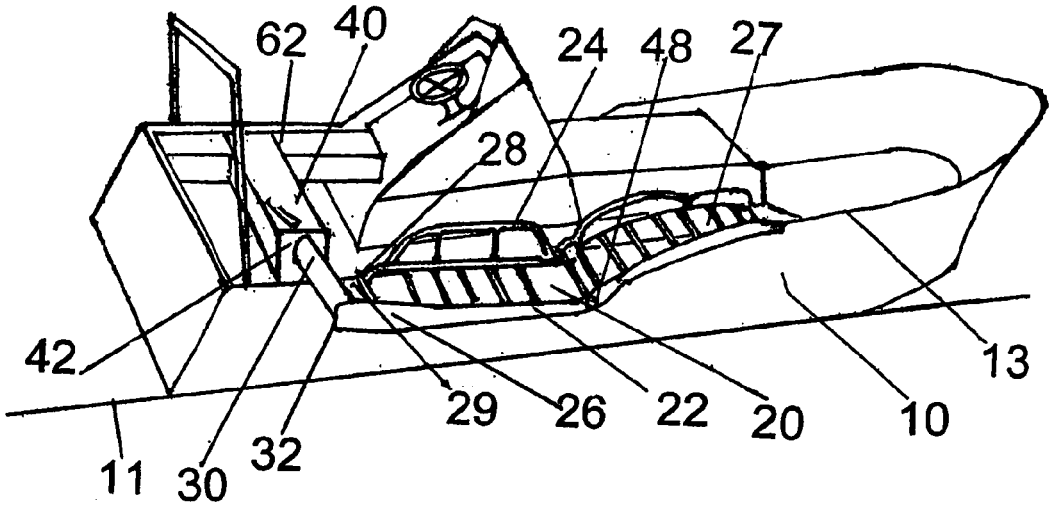
FIG. 1 shows a rescue vessel with a scooping up basket according to the invention. The basket, as an extended bed or the like, is placed in a by and large horizontal position outside the ship's railing.

Initially, reference shall be made to FIG. 1 which shows the vessel 10, with the place of the pilot 15 and the rescue device according to the invention placed at the stern. The figure shows the drive mechanism with the scooping up basket 20.

The basket 20 stands horizontally flat/straight or in a collapsed position outside the railing 13 of the ship. The waterline is shown by 11.

The basket 20 consists of a wicket construction 22 with longitudinal and crosswise beams/pipes and handles 24.

The one end 26 of the longitudinal outer frame part 22 of the basket 20 is fitted to the one end 32 of an extended body or a pipe 30 which constitutes a drive gear, e.g., a section of a piston/cylinder unit in a housing 40, in the pushing out mechanism to operate for turning the rescue basket.

There is a distance (an opening) 29 between the inner, end edge 28 of the basket and the pipe 30 so that the whole unit can be pulled in with the pipe such that the end edge 28 can glide and pass in and along and on the outside of the side wall of the housing 40 when the pipe 30 is pulled back into the housing 40.

During pushing out of the pipe from the position according to FIG. 1, the basket tilts downwards so its free end 27 lies down in the water and can catch objects/persons. This is shown in FIG. 2.

Figure 2:
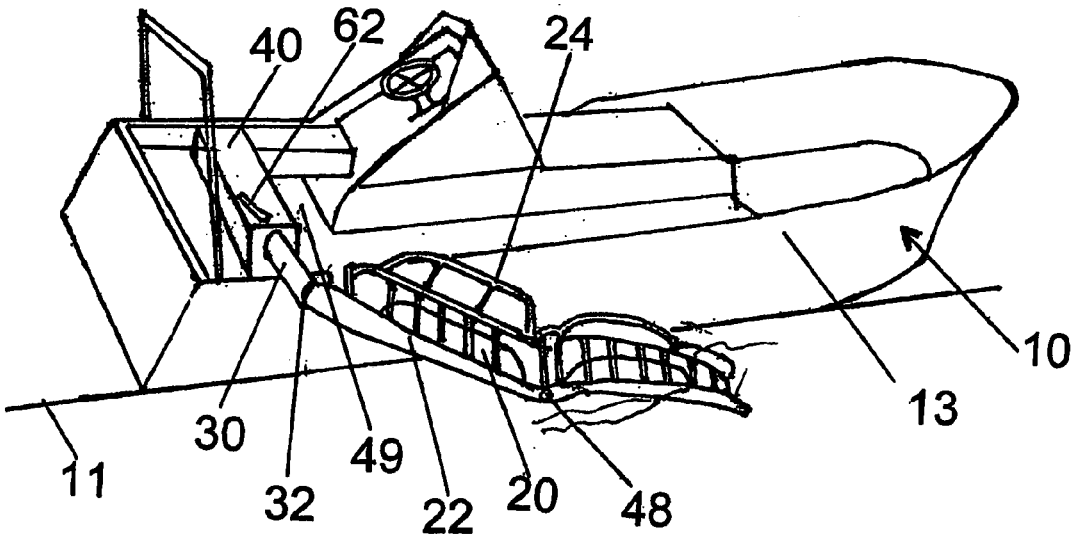
FIG. 2 shows the same as FIG. 1, but where the basket is tilted with its free end in an inclined position down into the sea.
Figure 4:
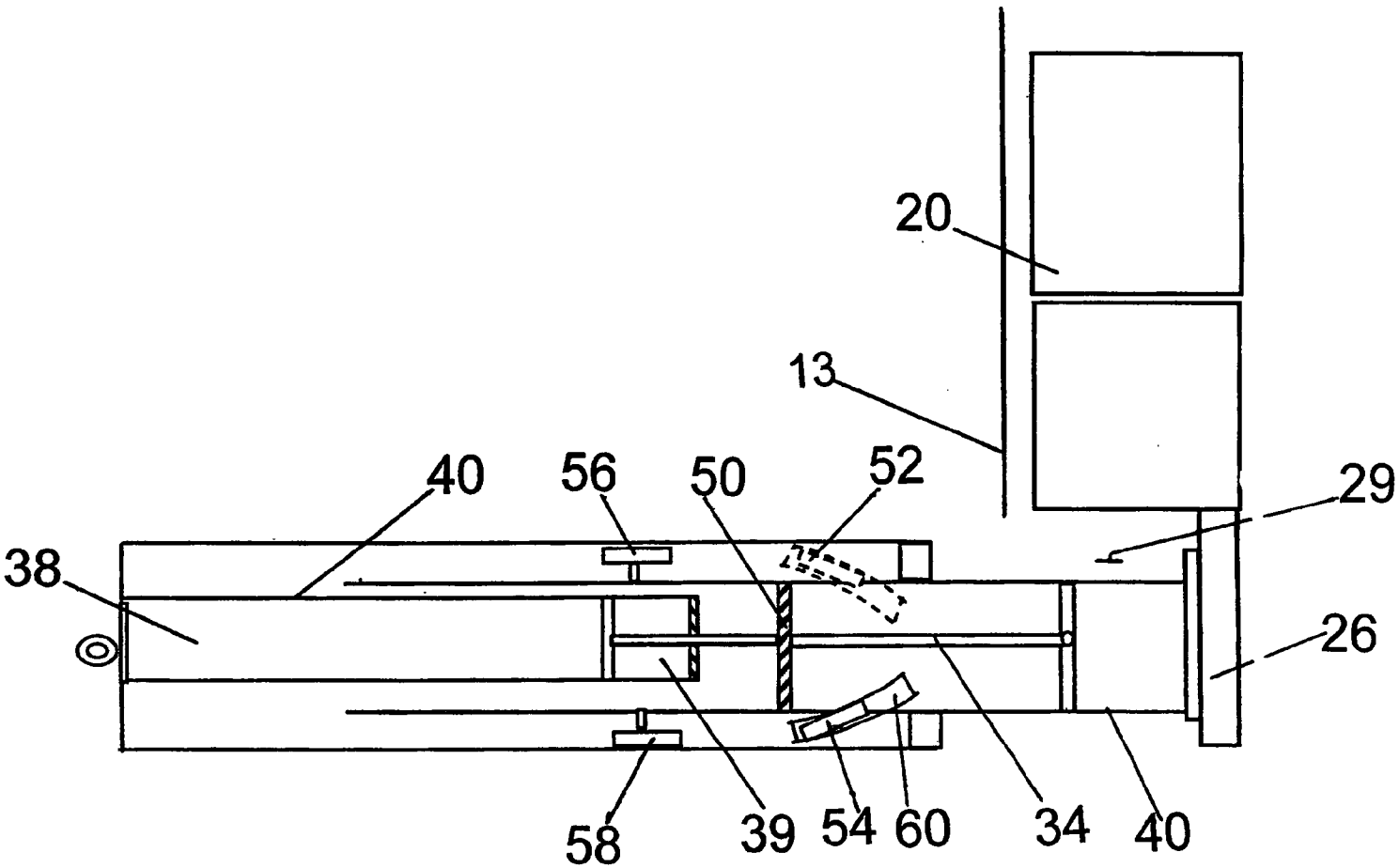
FIG. 4 shows the same elements in pushed out position.
Figure 5:
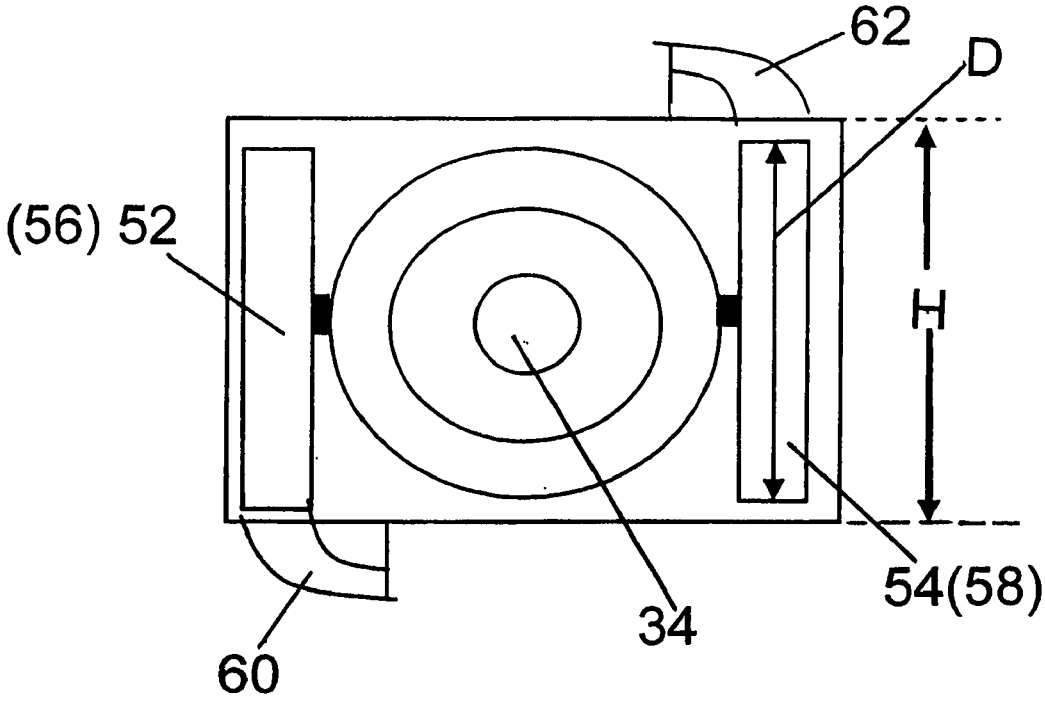
FIG. 5 shows the wheel construction in a cross section along the line A—A in FIG. 3, but where, in addition, the recesses in the bottom/ceiling further forward are also shown.

When the pipe 30 is pushed in its axial direction from the position in FIG. 1 to the position in FIG. 2, the pipe 30 is at the same time rotated about its longitudinal axis so that the basket tilts. To explain this tilting of the basket, reference is now made to FIGS. 3, 4 and 5.

The pipe 30 runs through a mounting (a bearing/support) and into a guiding channel where the device is guided by a free wheel (or pair of wheels) and a guiding wheel (pair of wheels). The rescue stretcher or the scooping up basket 20 is fastened to the pipe 30 which can be pushed out. It appears that the pipe is fastened to an extension 26 of the one outer longitudinal frame part 22 of the stretcher and which is reinforced. The mechanism, in the form of the pipe 30, is arranged to be moved on said wheels running freely forwards and backwards inside the housing 40, and with the one end with the fitted rescue basket extending out of the one end of the housing. The housing is formed by a mainly square, extended box 40 which is closed in one end, while the outer end comprises a circular opening with a gliding and sealing gasket through which the pipe 30 can glide.

The forward end of a piston rod 34 is secured inside the pipe 30 in an area at the outer end 32 of the pipe. The other or rear end of the piston rod 34 comprises the piston 36 itself, which is set up to glide inside a second pressure cylinder pipe 41 arranged co-axially inside the pipe 30.

The one end of the pressure cylinder pipe 41 is secured to the rear wall of the housing, while the other end is secured to the pipe 30 at 32 by means of a frame element 33. The outer (forward) end of the pressure cylinder pipe 41 comprises a pressure-tight penetration (gasket) at 35 for the piston rod 34 which runs further to the anchorage point 32/33 in the outer pipe 41. A slide support element 43 provides a support of the pipe 30 to the housing 40.

By pressurizing the chamber 38 at one side of the piston 36 with hydraulic oil, the pipe 30 will be pushed outwards (forward), while putting the chamber 39 on the other side under pressure, the piston is pulled in, in the opposite direction. Tubing for supplying and carrying away of hydraulic oil and also the pressure aggregate in the construction is not shown.

Further details of the pipe 30 that can be pushed out shall now be explained. The pipe is divided into two sections, an outer (forward) rotary pipe section 30A and an inner (rear) stationary pipe section 30B. The two sections are joined with the help of a free joint, such as a slew ring 50, only shown schematic on FIGS. 3 and 4. The free joint 50 ensures that the outer pipe 30A can be rotated while the inner pipe is not rotated. This ensures that the pipes/wheels can move independently of each other, as will be explained more in detail in the following. The free joint/slew ring does not touch the piston/cylinder unit 34,36 which is positioned inside the pipe sections 30A,30B.

Each pipe section 30A and 30B, respectively, is fitted with its own pair of wheels 52,54 and 56,58, respectively, both at its shorter distance from the slew ring 50. Each wheel in the pair stands diametrically on opposite sides of the respective pipe sections as shown in the cross section in FIG. 5. The wheel diameter D corresponds approximately to the height H of the extended square box-formed housing 40, i.e. the wheels fill the height with a sufficient clearance so that the wheels can roll inside the box. There can be a bigger clearance sideways to make it possible for one of the wheel pairs to roll around the longitudinal axis of the pipe.

When the pipes are made to be pushed outwards to launch the rescue basket or stretcher, the housing 40 comprises appliances which force the outer pipe 30A to be rotated in about the axial direction, so that the basket 20 tilts downwards, while the inner pipe 30B is not rotated. The rotation starts when the inner edge 49 of the basket 20 has come clear of the side 13 of the vessel.

In the bottom floor and ceiling, respectively, of the housing, a cut-out 60,62 (recess) is formed in the shape of a spiral housing and, as can be seen, the cut-outs are formed mutually diametrically opposite. When the unit of pipes 30A, 30B are pushed forward, the wheel 52 will fall down into the recess 60 in the bottom plate, while the wheel 54 is pushed up into the recess 62. Thus the pipe section 30A is rotated around its longitudinal axis.

It is also possible that respective upward gradients, which ensure that the wheels are forced into the rotational movement, are formed inside the housing on diametrically opposite sides of the recesses.

The guiding wheels 52,54 will thereby follow the recesses/cut-outs which lie in the guiding channel and be forced into a rotational movement. However, the inner pipe 30B will not be rotated.

According to an alternative solution, the inner pipe can constitute a part of a screw construction, which functions so that the inner pipe can be screwed outwards and inwards. The outer pipe can, at the same time, rotate freely in relation to the inner pipe and can exert its function to swing the basket, as described in the example and shown in the figures.

Figure 6:
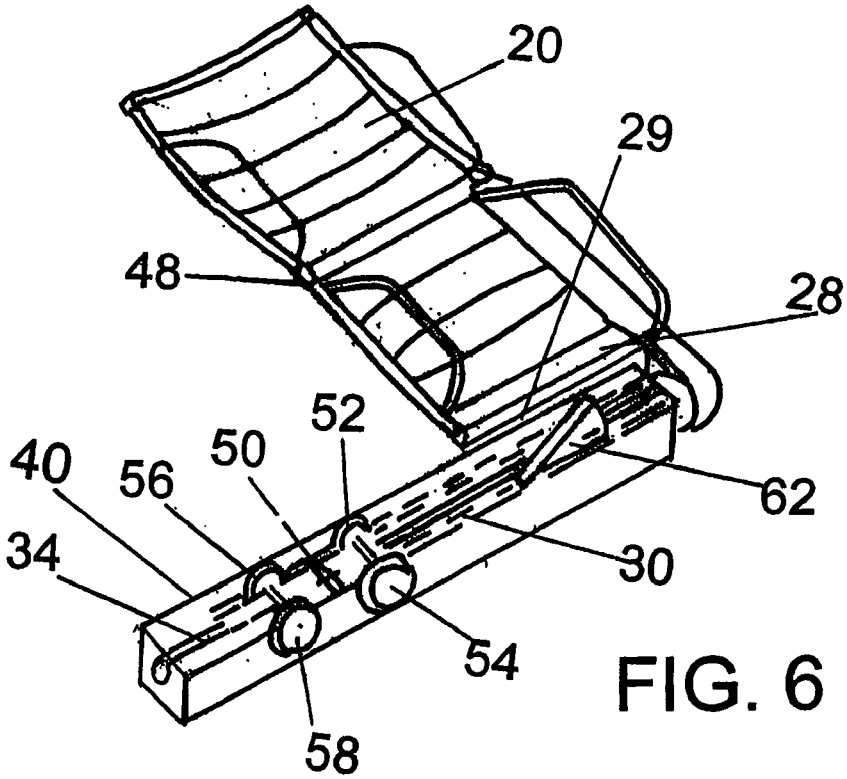
FIG. 6 shows a perspective diagram, partially in section, of the housing with pipe construction and the stretcher/basket.

The construction according to the invention is also illustrated directly from above, partially in perspective, in FIG. 6. Furthermore, the recesses are also shown in the FIGS. 3 and 4.

Figure 7:
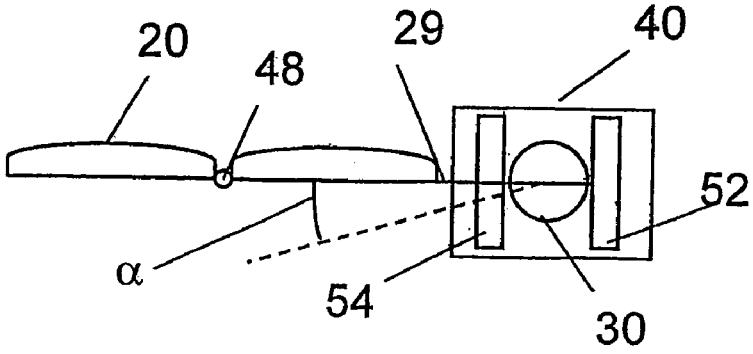
FIG. 7 shows a corresponding situation as in FIG. 5, but where the horizontal position of the basket is included.
Figure 8:
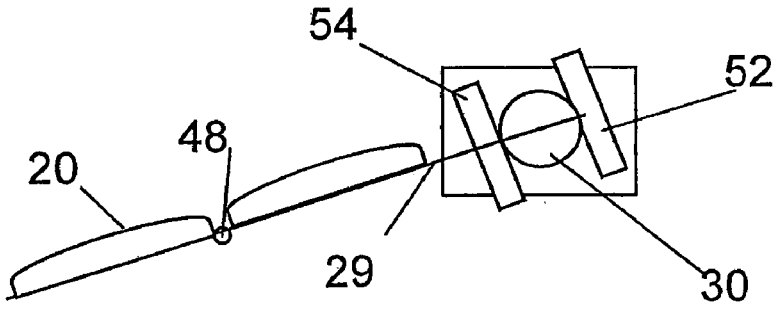
FIG. 8 shows the same section as in FIG. 7, but where the basket is tilted down into the sea.

The rotation of the rescue basket between the two positions is shown in the FIGS. 7 and 8. FIG. 7 shows the basket tilted downwards so that the end lies down in the sea. In this position the pipe is pushed out all the way to its stop position.

FIG. 8 shows the basket in a horizontal position where it is withdrawn into the boat. The basket can be articulated at 48 so that it can be folded. FIG. 8 also shows that it can be sufficient that the stretcher/basket can be swung in the area of about 30° between horizontal position onboard and tilted position down in the sea.

Figure 3:
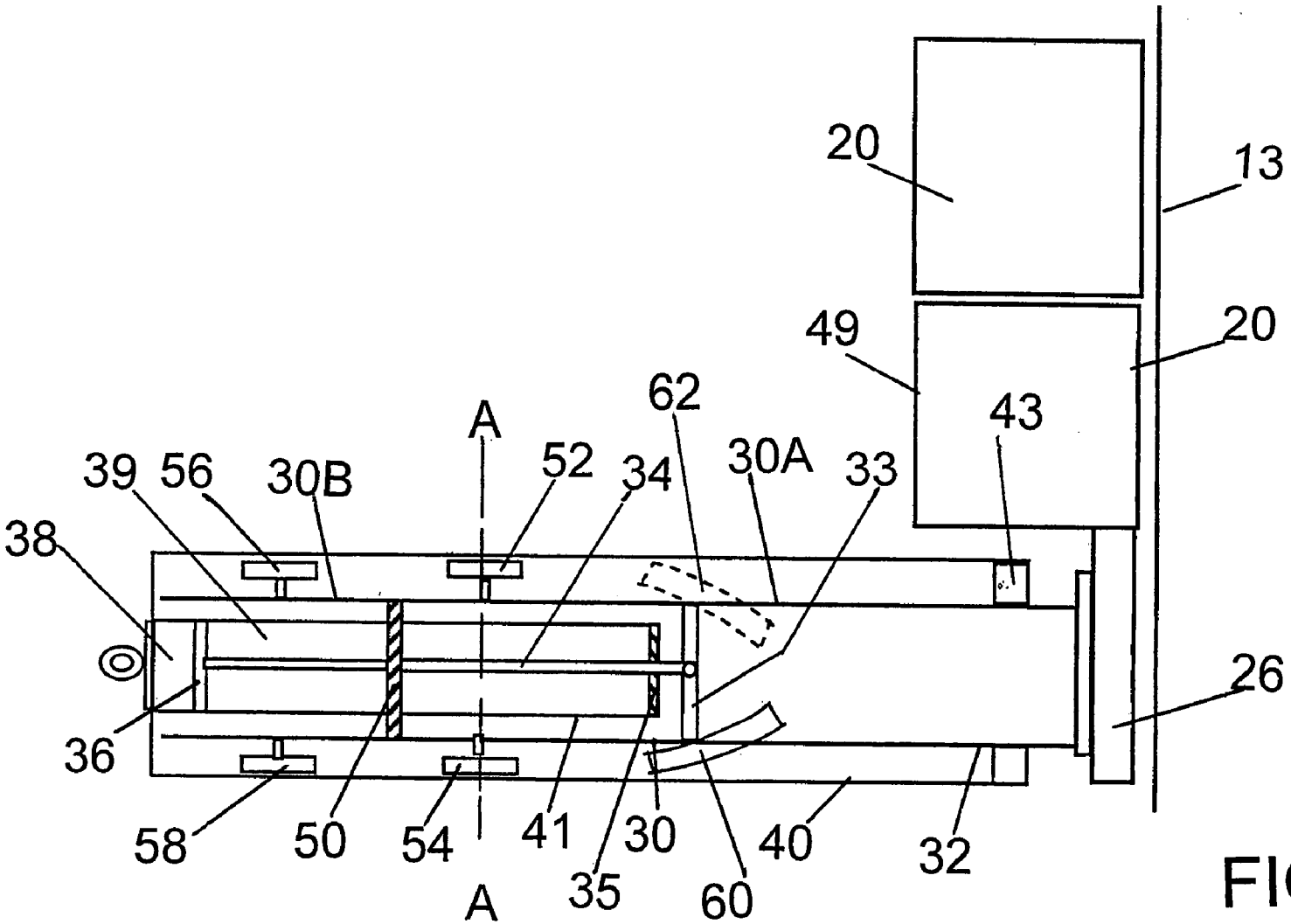
FIG. 3 shows a longitudinal plane diagram of the mechanism with the piston/cylinder unit in withdrawn position.
Figure 9:
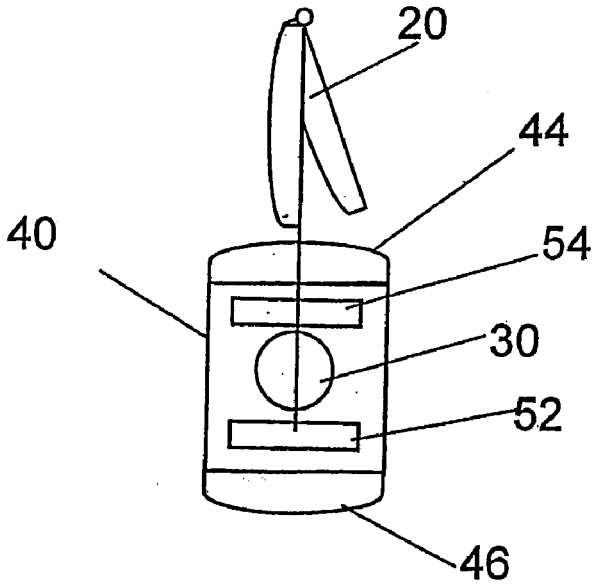
FIG. 9 shows dome-formed extensions of the housing to give room for the wheels so that the basket can be swung up to a vertical position.

When the curve is in position horizontal with, and on, the deck, it can be swung upwards to a vertical parked position. This position is shown in FIG. 9. When the pipe construction stands in inner position, as shown in FIG. 3, the wheels 52, 54 are directly above and below, respectively, the dome-shaped protuberances 44,46 in the bottom and ceiling, respectively, of the housing, so that the basket can be swung upwards. Thus there is space in the upper and lower domes for the wheels to rotate. This means that the wall parts here have a round dome shape. In this way the basket can be placed vertically and collapsed, thus not obstructing the movements onboard the vessel.

When the basket is to be used again, it is pivoted down from the position in FIG. 9 and the pipe movements are initiated.

Figure 10:
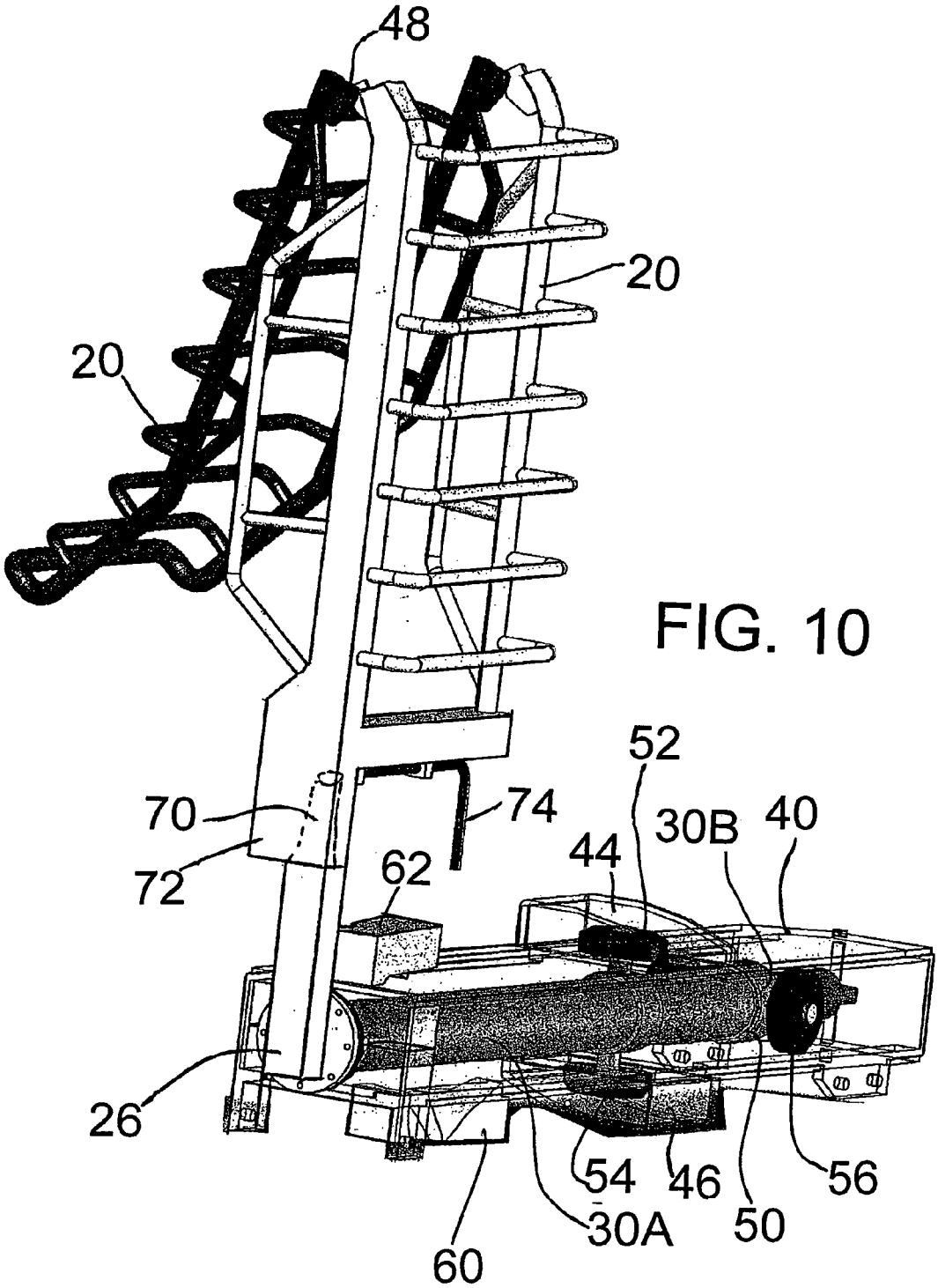
FIGS. 10–12 illustrate perspective drawings of real embodiments of the invention, with the basket in three main positions.
Figure 11:
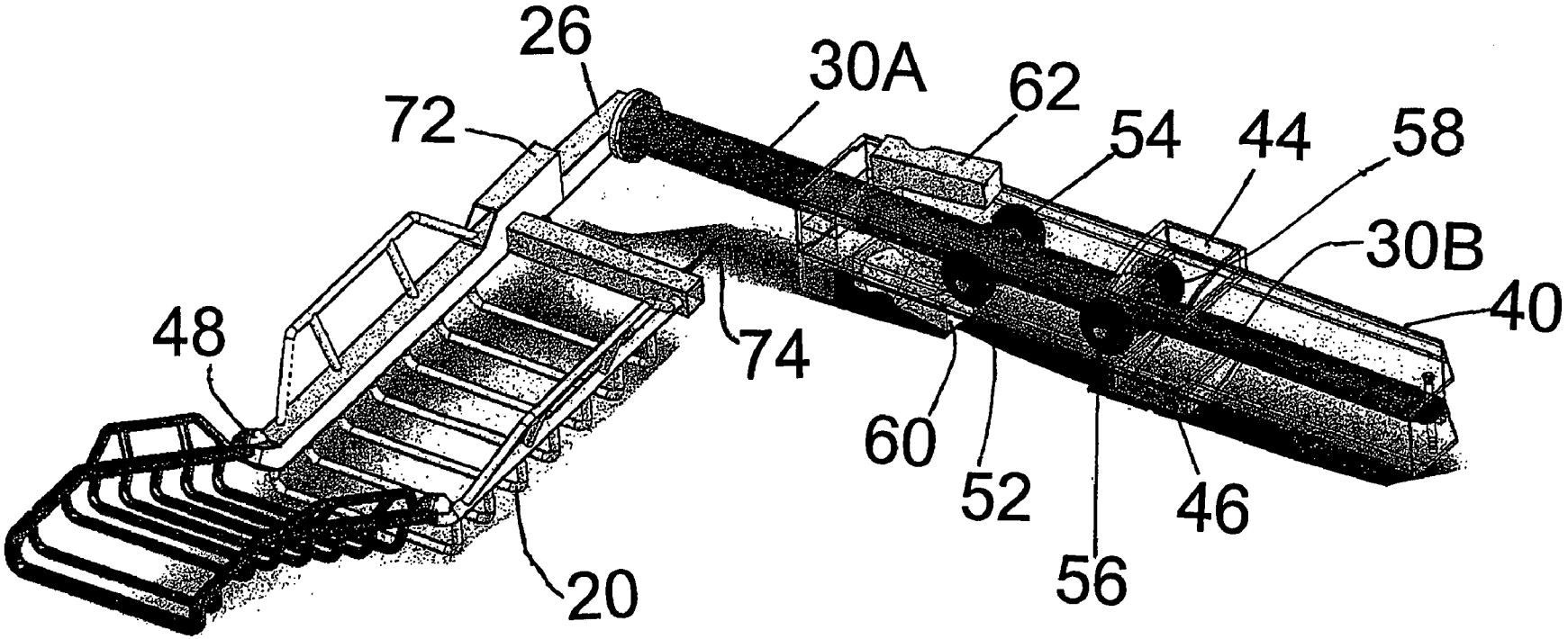
Figure 12:
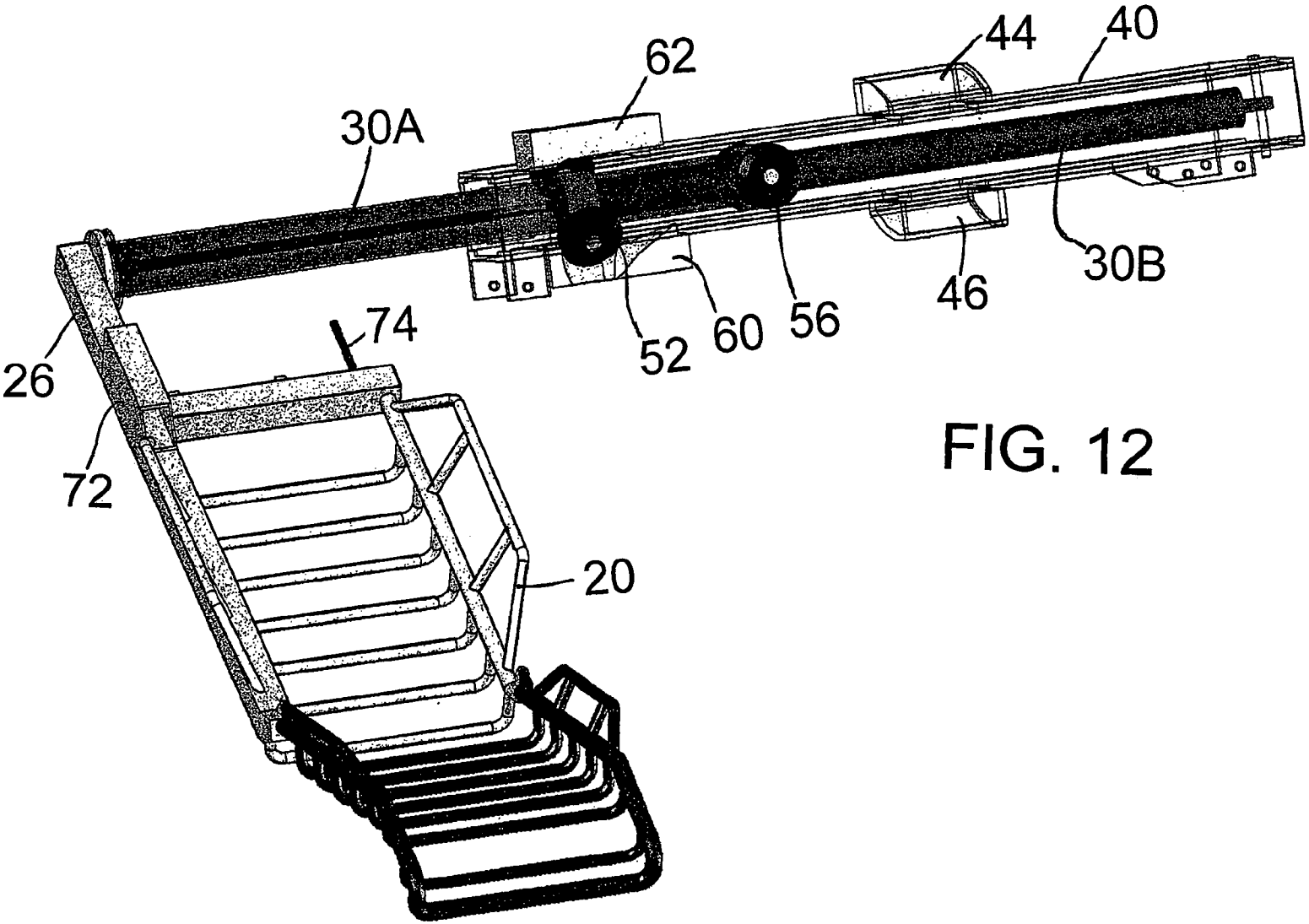

FIG. 10–12 illustrates real embodiments of the movements of the basket in its three main positions:

its upright vertical position, its mainly horizontal position, and its downwardly tilted position.

FIGS. 13A and 13B show how the basket may be released from the tilting mechanism onboard the vessel to be further used as a stretcher. The element 22 includes a bar 70 closely fitted to a hollow shape 72 of the element 26 of the wicket construction 22. When inserting the bar 70 into the hollow frame 72, a locking pin or bar 74 is inserted along the end section 28 of the stretcher 20. When removing the locking bar 74, the stretcher may be pulled off the mechanism to bring the person on it to a hospital, for example.

FIG. 14A shows the pivoting hinge 48 of the basket. The pivot hinge 48 is shown in more detail in FIG. 14B.

Parking: In this position the basket is fully withdrawn, the free wheels and the guiding wheels are in parked mode.

As railings: After parked mode, the basket is raised alongside the vessel. In this case, one has fitted a joint 48 at the fastening end of the basket.

Preparing:

The basket is laid down in horizontal position, the lower part is set out.

Activation of System/Basket, Setting Out and Bringing Onboard:

Power sources (for example, a hydraulic cylinder) are activated and push the main pipe outwards. The guiding wheels will move out of the guiding track, something which leads to the basket being lifted out of the parked position and into the walls/track of the channel. The wheels will follow the track of the channel until they meet the outer guiding track. In this position, the basket moves parallel to the side of the ship and out past the railings of the vessel.

When the guiding wheels go into the outer guiding track (two pieces, an upper and a lower), the basket rotates/moves into scooping up position until the wheels reach the bottom of the guiding track and the basket has reached its wanted position.

When the object is caught by the basket, the system is driven the opposite direction. This involves the power source pulling the main pipe inwards, something that leads to the guiding wheels being pulled out of the guiding tracks, with the result that the basket is lifted up into horizontal position and is pulled sideways onboard the vessel, if necessary, all the way into parked position.

Application of the construction according to the invention.

As mentioned, the invention can be used to rescue people from the sea, as the basket is pulled onboard in a horizontal position. But it is of course possible to manoeuvre the vessel in towards a quay so that the stretcher/basket can hang over the quay deck such that a rescued person can be taken care of.

According to the invention, the device can be fitted in connection to a landing site in the form of a quay, where the basket is arranged to be shifted between its horizontal position on the quay and its tilted position down in the sea where objects or persons can be rescued ashore and onto the quay.

The big advantage with the construction according to the invention is that both the pushing outwards and tilting downwards of the basket can be carried out in a continuous, smooth movement, and with a single piston/cylinder unit. Furthermore, the pilot of the vessel can easily control the manoeuvring of the vessel and, at the same time, control the progress of the operation.

The invention claimed is:

1. A device for scooping up or rescuing objects lying in the sea comprising a basket, where the basket, in connection to a landing site, such as onboard a vessel, can be shifted from a parked position to a rescue position adjoining the surface of the sea, and vice versa, an extended axially shifted body being fastened to the basket, said body capable of a rotary movement about its longitudinal axis for setting of the basket in rescue position from a parked position and vice versa, and a housing comprising a guiding unit, the guiding unit adapted to cause the body to rotate about its longitudinal axis when the body is moved axially.

2. The device according to claim 1, characterised in that at least a portion of the body is arranged to be displaced inside said housing, said portion permanently connected to said guiding unit.

3. The device according to claim 2, characterised in that the guiding unit comprises a number of wheels arranged to roll against an inner wall of the housing when the body is moved axially, and the housing comprises appliances, which force a rotational movement, formed in a spiral shape that ensures that the number of wheels, and thereby the body also, are rotated with the corresponding spiral shape.

4. The device according to claim 3, characterised in that the guiding unit comprises a pipe construction having an outer pipe and an inner pipe lying axially inside the housing, the pipes mutually joined via a joint so that the outer pipe can be rotated about the axial direction in relation to the inner pipe.

5. The device according to claim 4, characterised in that the joint is a free joint which ensures that the outer pipe can be rotated while the inner pipe can not be rotated, but only displaced axially.

6. The device according to claim 1, comprising a pushing appliance to move the body axially.

7. The device according to claim 4, characterised in that the inner pipe constitutes a part of a screw construction, and can be screwed outwards and inwards at the same time as the outer pipe is free to rotate in relation to the inner pipe and can carry out its function and rotate the basket between a parked position and a rescue position and vice versa.

8. The device according to claim 6, characterised in that the pushing appliance is arranged to function inside the pipe sections.

9. The device according to claim 4, comprising appliances which force the wheels connected to the outer pipe section to rotate.

10. The device according to claim 9, characterised in that the appliances that force the rotation are formed by recesses in the floor and ceiling, respectively, of the housing into which the wheels enter or exit and cause the rotation.

11. The device according to claim 10, characterised in that the recesses are formed with a spiral shape and are mutually diametrically placed in relation to each other so that when the pipes are pushed forward, a first wheel will fall into the recess in the floor, while a second wheel is pushed up into the recess in the ceiling.

12. The device according to claim 11, characterised in that on diametrically opposite sides of the recesses, respective uphill gradients are made which result in the wheels being forced into the rotary movement.

13. The device according to claim 1, characterised in that the basket is arranged to be rotated over a sector of about 30°.

14. The device according to claim 1, characterised in that when the landing site is a vessel, the body is set up to start the rotation when an inner edge of the basket has come clear of a side of the vessel.

15. The device according to claim 4, characterised in that there is a distance between an inner short side of the basket and the outer pipe so that an inner short side of the basket can pass in and alongside the outside of the housing when at least a portion of the body is pulled back in the housing.

16. The method for scooping or rescuing an object in the sea, comprising the steps of installing a device according to claim 1 to a vessel, and operating the device to scoop or rescue the object.

17. The method for scooping or rescuing an object in the sea, comprising the steps of installing a device according to claim 1 onto a landing site and shifting the basket between its horizontal position on the landing site and its tilted position down in the sea where the object can be scooped or rescued.

18. The device according to claim 7, characterised in that the basket is rotated to the rescue position when one set of wheels are rotated at a first appliance, a portion of the basket is rotated to a vertical storage position when the same set of wheels are rotated at a second appliance, and the basket is rotated to a horizontal position when the same set of wheels are positioned between the first appliance and the second appliance.

19. The device according to claim 18, comprising a locking pin that locks a portion of the basket in the vertical storage position.

* * * * *